US007861964B2

(12) United States Patent
Cittadino et al.

(10) Patent No.: US 7,861,964 B2
(45) Date of Patent: Jan. 4, 2011

(54) APPARATUS FOR SECURING AND DISPENSING SHEET PRODUCT

(75) Inventors: Antonio M. Cittadino, Appleton, WI (US); Steven B. Mattheeussen, Hortonville, WI (US); Harold J. Goeking, Oshkosh, WI (US); Eric J. Jandrain, Green Bay, WI (US)

(73) Assignee: Georgia-Pacific Consumer Products LP, Atlanta, GA (US)

( * ) Notice: Subject to any disclaimer, the term of this patent is extended or adjusted under 35 U.S.C. 154(b) by 0 days.

(21) Appl. No.: 12/050,714

(22) Filed: Mar. 18, 2008

(65) Prior Publication Data

US 2009/0236464 A1 Sep. 24, 2009

(51) Int. Cl.
*B65H 16/04* (2006.01)

(52) U.S. Cl. ..... 242/597.5; 242/599.4

(58) Field of Classification Search ..... 242/560, 242/597.8, 597, 5, 597.6, 599.4, 597.1, 597.3, 242/597.4; 312/34.22, 34.8, 34.19, 34.21, 312/34.23; D6/522, 523

See application file for complete search history.

(56) References Cited

U.S. PATENT DOCUMENTS

| | | | | |
|---|---|---|---|---|
| 1,098,862 | A | | 6/1914 | Wheeler |
| 2,419,798 | A | | 4/1947 | Stone |
| 2,632,605 | A | | 3/1953 | Lee |
| 3,346,208 | A | | 10/1967 | Hoffman et al. |
| 3,375,995 | A | * | 4/1968 | Roman ..... 242/597.6 |
| 3,484,052 | A | | 12/1969 | Clarke |
| 3,792,822 | A | | 2/1974 | Underhill |
| 4,436,249 | A | * | 3/1984 | Santa Lucia et al. ..... 242/484.6 |
| 5,100,075 | A | | 3/1992 | Morand |
| 5,370,339 | A | | 12/1994 | Moody et al. |
| 5,556,054 | A | * | 9/1996 | Neveu et al. ..... 242/597.6 |
| 5,813,624 | A | * | 9/1998 | Grasso et al. ..... 242/560 |
| 6,036,134 | A | | 3/2000 | Moody |
| 6,202,956 | B1 | * | 3/2001 | Grasso et al. ..... 242/560 |
| 6,328,246 | B1 | | 12/2001 | Hjort et al. |
| 6,416,011 | B2 | * | 7/2002 | Granger ..... 242/422.4 |
| 6,450,439 | B1 | | 9/2002 | van Rees |
| 6,628,789 | B1 | | 9/2003 | Colby |
| 2005/0117760 | A1 | | 6/2005 | Colby |

* cited by examiner

*Primary Examiner*—William A Rivera
(74) *Attorney, Agent, or Firm*—Joel T. Charlton

(57) ABSTRACT

A spindle sleeve for a sheet product dispenser is disclosed having a body with a first end, a second end, an inner diameter, an outer diameter, and a central longitudinal axis. The body includes a first portion disposed proximate the first end, a second portion disposed proximate the second end, and a third portion disposed between the first and second portions. The third portion has a U-shaped cutout defining a cantilevered flexible finger oriented to align with the central longitudinal axis, and the first and second portions have unbroken surfaces of the body around the perimeter of the body at the first and second ends, respectively. The finger has a dorsal-type fin extending perpendicular to the outer surface of the finger.

9 Claims, 3 Drawing Sheets

APPARATUS FOR SECURING AND DISPENSING SHEET PRODUCT

BACKGROUND OF THE INVENTION

The present disclosure relates generally to the securing and dispensing of sheet product, more particularly to the securing and dispensing of sheet product from a coreless roll, and even more particularly to a spindle sleeve for use with the dispensing of sheet product from a roll.

Sheet product roll dispensers can include roll support spindles that incorporate a sleeve having a rotational degree of freedom relative to the support spindle, for dispensing of the sheet product. To increase an amount of friction between the sleeve and the roll support spindle, and for reducing excessive rotation of a roll of sheet product and overspending of the sheet product, the sleeve may incorporate engagement features that are responsive to installation of the roll of sheet product thereupon to cause at least a portion of the sleeve to contact both the support spindle and the coreless inner diameter of the sheet product roll. Manufacturing tolerances of sheet product rolls can result in inner diameter variations from one roll of sheet product to the next. In some circumstances, the inner diameter variation and interaction between the sleeve and the inner diameter of the sheet product roll can result in "telescoping", or axial displacement of a center portion of the sheet product roll in response to installation of the roll upon the sleeve. Accordingly, there is a need in the art for a sheet product dispensing arrangement that overcomes these drawbacks.

BRIEF DESCRIPTION OF THE INVENTION

An embodiment of the invention includes a spindle sleeve for a sheet product dispenser, the spindle sleeve having a body with a first end, a second end, an inner diameter, an outer diameter, and a central longitudinal axis. The body includes a first portion disposed proximate the first end, a second portion disposed proximate the second end, and a third portion disposed between the first and second portions. The third portion has a U-shaped cutout defining a cantilevered flexible finger oriented to align with the central longitudinal axis, and the first and second portions have unbroken surfaces of the body around the perimeter of the body at the first and second ends, respectively. The finger has a dorsal-type fin extending perpendicular to the outer surface of the finger.

Another embodiment of the invention includes an apparatus for dispensing sheet product from a coreless roll supply of the sheet product. The apparatus includes a first housing member and a second housing member closable and lockable to the first housing member, the first and second housing members defining an interior space for receiving the sheet product when the second housing member is closed upon the first housing member, and a support frame with a spindle disposed within the housing for receiving and supporting the sheet product. Disposed upon the spindle is a spindle sleeve as described above. Upon installment of the coreless roll supply upon the spindle sleeve, the dorsal-type fin is pushed by the coreless roll supply toward the spindle, thereby biasing the cantilevered flexible finger against the spindle creating an interference fit of the spindle sleeve between the spindle and the coreless roll supply.

These and other advantages and features will be more readily understood from the following detailed description of preferred embodiments of the invention that is provided in connection with the accompanying drawings.

BRIEF DESCRIPTION OF THE DRAWINGS

Referring to the exemplary drawings wherein like elements are numbered alike in the accompanying Figures.

DETAILED DESCRIPTION OF THE INVENTION

An embodiment of the invention provides a spindle sleeve that includes one or more flexible fingers with fins disposed proximate a central region of the sleeve. A U-shaped cutout in the sleeve body defines each flexible finger, which forms a cantilevered spring from the body of the sleeve. In an embodiment, the fins are dorsal-type fins that include a rounded tip to allow the inner diameter of a coreless roll of sheet product to slide on and off of the sleeve without catching on an edge of the fin.

The term "sheet products" as used herein is inclusive of natural and/or synthetic cloth or paper sheets. Sheet products may include both woven and non-woven articles. There are a wide variety of nonwoven processes and they can be either wetlaid or drylaid. Some examples include hydroentagled (sometimes called spunlace), DRC (double re-creped), airlaid, spunbond, carded, paper towel, and meltblown sheet products. Further, sheet products may contain fibrous cellulosic materials that may be derived from natural sources, such as wood pulp fibers, as well as other fibrous material characterized by having hydroxyl groups attached to the polymer backbone. These include glass fibers and synthetic fibers modified with hydroxyl groups. Examples of sheet products include, but are not limited to, wipers, napkins, tissues, rolls, towels or other fibrous, film, polymer, or filamentary products.

In general sheet products are thin in comparison to their length and breadth and exhibit a relatively flat planar configuration and be flexible to permit folding, rolling, stacking, and the like. The sheet product may have perforations extending in lines across its width to separate individual sheets and facilitate separation or tearing of individual sheets from the roll at discrete intervals. Individual sheets may be sized as desired to accommodate the many uses of the sheet products. For example, perforation lines may be formed every 13 inches to define a universally sized sheet. Multiple perforation lines may be provided to allow the user to select the size of sheet depending on the particular need.

Figure 1:
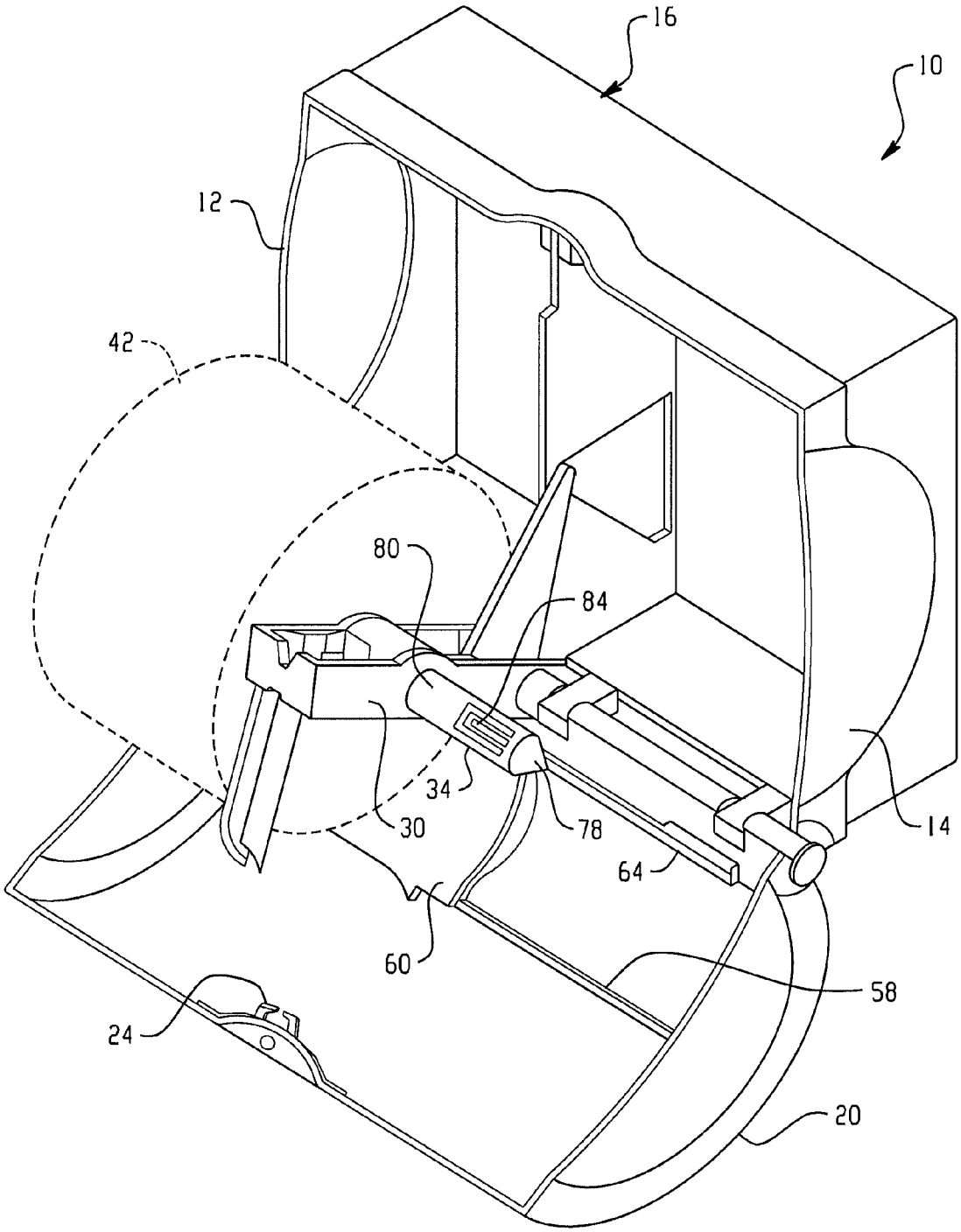
FIG. 1 depicts a sheet product dispenser in accordance with an embodiment of the invention.

FIG. 1 depicts a dispenser 10 having a first housing member 16 with ends 12, 14, and a second housing member 20 closable upon the first housing member 16, the first and second housing members defining an interior of the dispenser when the second housing member 20 is closed upon the first housing member 16. A latch 24 provides a means for latching and locking the second housing member 20 to the first housing member 16.

Figure 2:
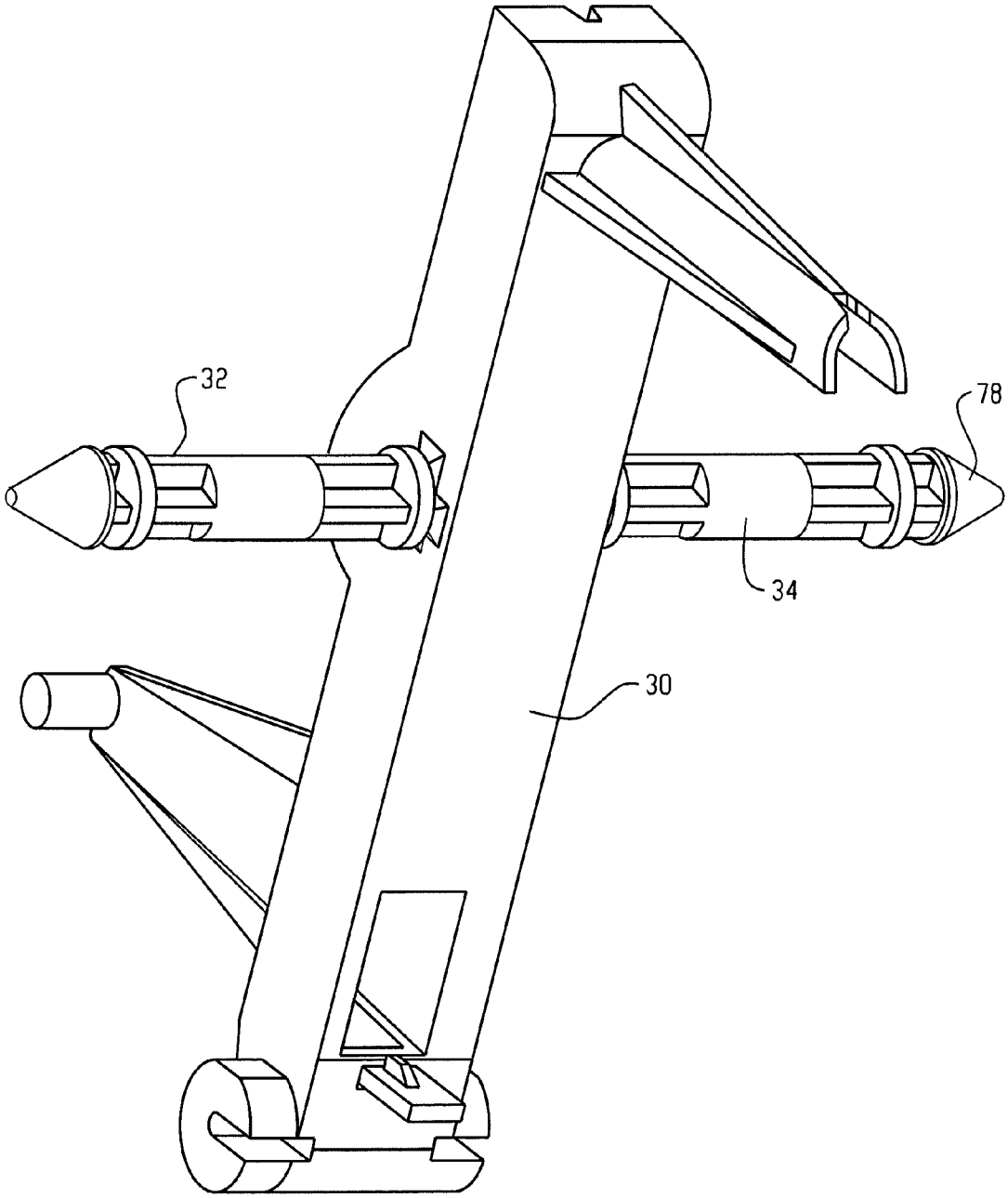
FIG. 2 depicts a roll support structure for use in the sheet product dispenser of FIG. 1 in accordance with an embodiment of the invention.

FIG. 2 depicts a roll support means including a support frame 30 having axially aligned roll support spindles 32, 34 projecting outwardly from the center of the support frame 30 and away from each other. As shown in FIG. 1, a roll of sheet product 42 is mounted on one of the roll support spindles 32, 34. However, it will be appreciated that each support spindle 32, 34 is suitable for receiving a roll of sheet product as described herein.

In one embodiment, an opening 58 in second housing member 20 accommodates a cover 60 slidably movable within the opening 58. The cover 60 is movable between a first cover location wherein a first roll of sheet product is exposed for user access and a second roll of sheet product is concealed or otherwise not exposed for user access, and a second cover location wherein the second roll of sheet product is exposed for user access and a first roll of sheet product is concealed or otherwise not exposed for user access. That is, the cover 60 may be slid relative to the housing 16, 20 by a manual force being exerted thereon between the first and second cover locations. At a first edge the cover 60 defines a slot that receives the second housing member 20, and at a second edge the cover 60 is received within a slot defined by the second housing member 20 and a longitudinally extending reinforcement member 64.

FIGS. 1 and 2 collectively depict the roll support spindles 32, 34 having a support shaft 78 and a sleeve 80 rotatably disposed about the support shaft 78 for insertion into the roll of sheet product. For example, the roll support spindles 32, 34 may be utilized with coreless rolls of toilet tissue, which typically have a small central opening. The support shafts 78 may tapered at the outer end thereof to facilitate entry of the roll support spindles 32, 34 and associated sleeve 80 into the central opening of the coreless toilet tissue roll.

In an embodiment, the sleeve 80 further includes at least one flexible finger 90 with a dorsal-type fin 84 disposed proximate a central region (third portion) of the sleeve 80, as will be described further below.

Figure 4:
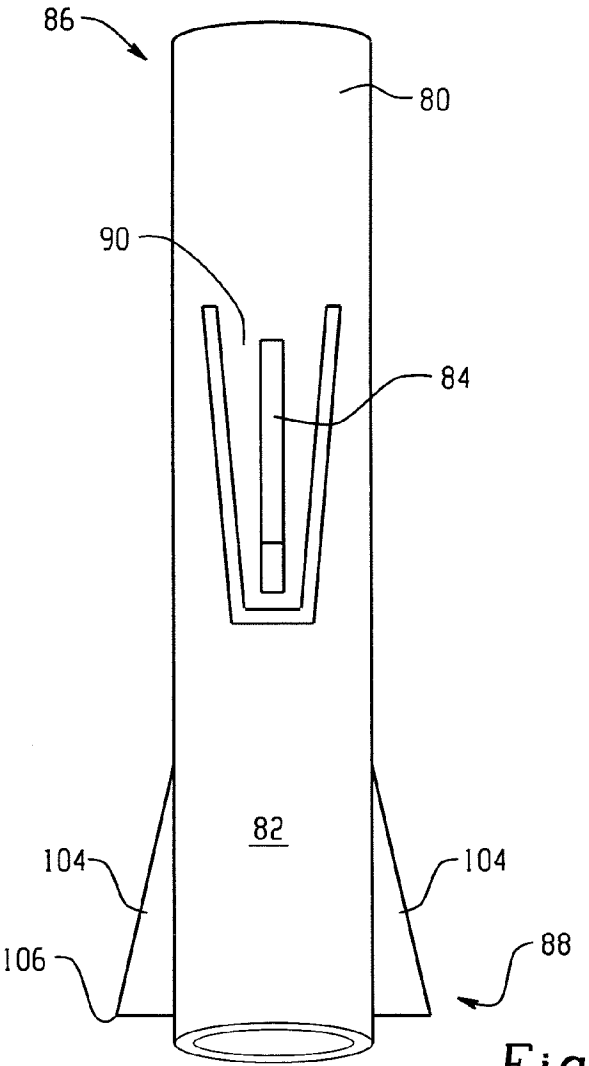
FIGS. 3 and 4 depict sleeves for use with the sheet product dispenser of FIG. 1 in accordance with an embodiment of the invention.
Figure 3:
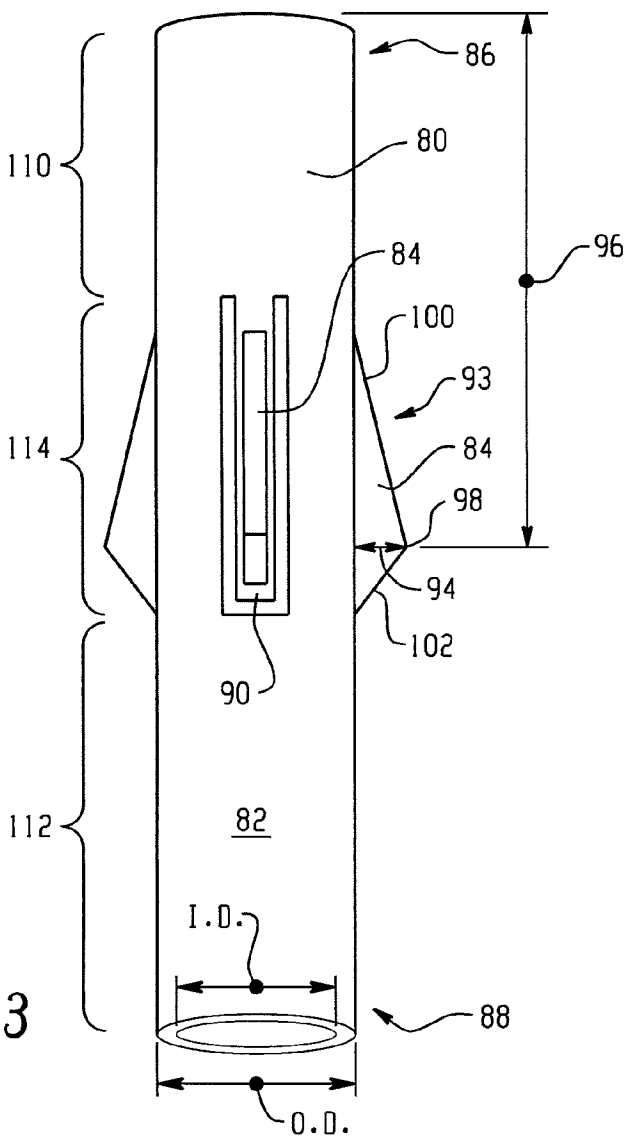

FIGS. 3 and 4 depict exemplary sleeves 80 having a body 82 with a first end 86 and a second end 88. The body 82 is further defined as having a first portion 110 proximate the first end 86, a second portion 112 proximate the second end 88, and a third portion 114 disposed between the first and second portions. The sleeves 80 include the dorsal-type fin 84 disposed in the region of the third portion 114.

The fin 84 is disposed upon a flexible element or finger 90 which is depressed inwardly upon insertion of the sleeve 80 into the roll of sheet product 42, such as a coreless toilet tissue roll for example, thereby creating frictional engagement between the fins 84 and the sheet product 42, and between the flexible fingers 90 of the sleeve 80 and the support spindles 32, 34, which serves to resist rotation of the sleeve 80 and the roll of sheet product 42 about the support spindles 32, 34 to an extent that the sheet product roll 42 will not "freewheel" relative to the roll support spindles 32, 34. For example, in response to disposal of a coreless roll sheet product 42 over the spindle support shaft 78, the innermost convolution of sheet product will contact the fin 84 disposed upon the finger 90. In so doing, the finger 90 will contact the support shaft 78 (at the support spindles 32, 34) and increase the frictional resistance therewith in order to prevent over-rotation of the roll 42 during the dispensing thereof.

FIG. 3 further depicts a side view of the fin 84, which in an embodiment includes a tapered profile 93 having a first tapered portion 100, a second tapered portion 102, and a rounded apex 98 having a radial dimension 94 beyond the outer diameter O.D. of the body 82. The first tapered portion 100 is disposed between the rounded apex 98 and the first portion 110 of the body 82, and the second tapered portion 102 is disposed between the rounded apex 98 and the second portion 112 of the body 82, the first and second tapered portions tapering from the rounded apex 98 to the outer diameter O.D. of the body 82. Stated alternatively, the radial dimension 94 of the fin 84 varies with an axial distance 96 of the fin 84 relative to at least one of the first end 86 and the second end 88 of the sleeve 80 (illustrated in FIG. 3 relative to the first end 86). The rounded apex 98 allows the roll 42 to slide on and off the sleeve 80 without catching upon a sharp edge of the fin 84. Inclusion of the tapered profile 93 and/or the rounded apex 98 of the fin 84 disposed upon the flexible finger 90 accommodates variations of an inner diameter of the roll 42, thereby reducing a likelihood of telescoping of the center portion of the roll 42 in response to insertion of the roll 42 upon the sleeve 80.

In an embodiment, a second set of dorsal-type fins 104 are rigidly disposed upon the body 82 of the sleeve 80 proximate the second end 88. Second fins 104 may have ends with tips 106 that are sharp or pointed to prevent the roll 42 from being easily pulled or pushed off of the sleeve 80. In another embodiment, the tips 106 may include rounded ends to allow removal of the roll 42 from the sleeve.

As disclosed, some embodiments of the invention may include some of the following advantages: an ability to accommodate different rolls of sheet product that have a variation of an inner diameter from one roll to another without resulting in telescoping of the roll during installation of the roll in the dispenser; and, an ability to effectively prevent free-wheeling of the roll of sheet product.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best or only mode contemplated for carrying out this invention, but that the invention will include all embodiments falling within the scope of the appended claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A spindle sleeve for a sheet product dispenser, comprising:

a body having a first end, a second end, an inner diameter, an outer diameter, and a central longitudinal axis;

the body having a first portion disposed proximate the first end, a second portion disposed proximate the second end, and a third portion disposed between the first and second portions, the third portion having a U-shaped cutout defining a cantilevered flexible finger oriented to align with the central longitudinal axis, the first and second portions having unbroken surfaces of the body around the perimeter of the body at the first and second ends, respectively; and the finger having a dorsal-type fin extending perpendicular to the outer surface of the finger, wherein the dorsal-type fin has a first tapered portion, a second tapered portion, and a rounded apex having a radial dimension beyond the outer diameter of the body, the first tapered portion being disposed between the rounded apex and the first portion of the body, and the second tapered portion being disposed between the rounded apex and the second portion of the body, the first and second tapered portions tapering from the rounded apex to the outer diameter of the body.

2. The spindle sleeve of claim 1, wherein:

the dorsal-type fin has a length substantially equal to the length of the cantilevered flexible finger.

3. A spindle sleeve for a sheet product dispenser, comprising:

a body having a first end, a second end, an inner diameter, an outer diameter, and a central longitudinal axis:

the body having a first portion disposed proximate the first end, a second portion disposed proximate the second end, and a third portion disposed between the first and second portions, the third portion having a U-shaped cutout defining a cantilevered flexible finger oriented to align with the central longitudinal axis, the first and second portions having unbroken surfaces of the body around the perimeter of the body at the first and second ends, respectively; and the finger having a dorsal-type fin extending perpendicular to the outer surface of the finger, wherein the second portion of the body comprises a second dorsal-type fin having a tip proximate the second end of the body, the tip having a radial dimension beyond the outer diameter of the body, the second dorsal-type fin having a taper that extends from the tip to the outer diameter of the body toward the third portion.

4. The spindle sleeve of claim 3, wherein:

the second dorsal-type fin is rigidly disposed on the body.

5. The spindle sleeve of claim 3, further comprising:

a plurality of the second dorsal-type fin, each of the plurality evenly spaced around the perimeter of the body.

6. An apparatus for dispensing sheet product from a cureless roll supply of the sheet product, the apparatus comprising:

a first housing member and a second housing member closable and lockable to the first housing member, the first and second housing members defining an interior space for receiving the sheet product when the second housing member is closed upon the first housing member;

a support frame with a spindle disposed within the housing for receiving and supporting the sheet product; and a spindle sleeve disposed on the spindle, the spindle sleeve comprising:

a body having a first end, a second end, an inner diameter, an outer diameter, and a central longitudinal axis;

the body having a first portion disposed proximate the first end, a second portion disposed proximate the second end, and a third portion disposed between the first and second portions, the third portion having a U-shaped cutout defining a cantilevered flexible finger oriented to align with the central longitudinal axis, the first and second portions having unbroken surfaces of the body around the perimeter of the body at the first and second ends, respectively; and the finger having a dorsal-type fin extending perpendicular to the outer surface of the finger;

wherein upon installment of the coreless roll supply upon the spindle sleeve, the dorsal-type fin is pushed by the coreless roll supply toward the spindle, thereby biasing the cantilevered flexible finger against the spindle creating an interference fit of the spindle sleeve between the spindle and the coreless roll supply, and wherein the dorsal-type fin has a first tapered portion, a second tapered portion, and a rounded apex having a radial dimension beyond the outer diameter of the body, the first tapered portion being disposed between the rounded apex and the first portion of the body, and the second tapered portion being disposed between the rounded apex and the second portion of the body, the first and second tapered portions tapering from the rounded apex to the outer diameter of the body.

7. An apparatus for dispensing sheet product from a coreless roll supply of the sheet product, the apparatus comprising:

a first housing member and a second housing member closable and lockable to the first housing member, the first and second housing members defining an interior space for receiving the sheet product when the second housing member is closed upon the first housing member;

a support frame with a spindle disposed within the housing for receiving and supporting the sheet product; and a spindle sleeve disposed on the spindle, the spindle sleeve comprising:

a body having a first end, a second end, an inner diameter, an outer diameter, and a central longitudinal axis;

the body having a first portion disposed proximate the first end, a second portion disposed proximate the second end, and a third portion disposed between the first and second portions, the third portion having a U-shaped cutout defining a cantilevered flexible finger oriented to align with the central longitudinal axis, the first and second portions having unbroken surfaces of the body around the perimeter of the body at the first and second ends, respectively; and the finger having a dorsal-type fin extending perpendicular to the outer surface of the finger;

wherein upon installment of the coreless roll supply upon the spindle sleeve, the dorsal-type fin is pushed by the coreless roll supply toward the spindle, thereby biasing the cantilevered flexible finger against the spindle creating an interference fit of the spindle sleeve between the spindle and the coreless roll supply, and wherein the second portion of the body comprises a second dorsal-type fin having a tip proximate the second end of the body, the tip having a radial dimension beyond the outer diameter of the body, the second dorsal-type fin having a taper that extends from the tip to the outer diameter of the body toward the third portion.

8. The apparatus of claim 7, further comprising:

a plurality of the second dorsal-type fin, each of the plurality evenly spaced around the perimeter of the body.

9. An apparatus for dispensing sheet product from a coreless roll supply of the sheet product, the apparatus comprising:

a first housing member and a second housing member closable and lockable to the first housing member, the first and second housing members defining an interior space for receiving the sheet product when the second housing member is closed upon the first housing member;

a support frame with a spindle disposed within the housing for receiving and supporting the sheet product; and a spindle sleeve disposed on the spindle, the spindle sleeve comprising:

a body having a first end, a second end, an inner diameter, an outer diameter, and a central longitudinal axis;

the body having a first portion disposed proximate the first end, a second portion disposed proximate the second end, and a third portion disposed between the first and second portions, the third portion having a U-shaped cutout defining a cantilevered flexible finger oriented to align with the central longitudinal axis, the first and second portions having unbroken surfaces of the body around the perimeter of the body at the first and second ends, respectively; and the finger having a dorsal-type tin extending perpendicular to the outer surface of the finger;

wherein upon installment of the coreless roll supply upon the spindle sleeve, the dorsal-type fin is pushed by the coreless roll supply toward the spindle, thereby biasing the cantilevered flexible finger against the spindle creating an interference fit of the spindle sleeve between the spindle and the coreless roll supply, and wherein the support frame further comprises a first of the spindle having a first of the spindle sleeve disposed thereon, and a second of the spindle having a second of the spindle sleeve disposed thereon, the first and second spindles being axially aligned.

* * * * *